United States Patent [19]

Parise et al.

[11] 4,046,989

[45] Sept. 6, 1977

[54] HOT WATER EXTRACTION UNIT HAVING ELECTRICAL IMMERSION HEATER

[75] Inventors: Carl Parise; Ralph Eugene Blackman, both of Reno; James M. Wimsatt, Carson City, all of Nev.

[73] Assignee: Parise & Sons, Inc., Reno, Nev.

[21] Appl. No.: 698,252

[22] Filed: June 21, 1976

[51] Int. Cl.[2] ..... F27D 11/02

[52] U.S. Cl. ..... 219/437; 15/321; 219/331; 219/441; 219/508; 219/523; 338/239

[58] Field of Search ..... 219/316, 320, 321, 328, 219/331, 435, 436, 437, 441, 508, 523, 536; 338/229, 239, 240; 15/321

[56] References Cited

U.S. PATENT DOCUMENTS

| | | | |
|---|---|---|---|
| 2,456,343 | 12/1948 | Tuttle | 338/239 X |
| 2,494,333 | 1/1950 | Daly | 338/239 |
| 2,575,113 | 11/1951 | Lennox | 338/239 X |
| 2,804,532 | 8/1957 | Lacy-Hulbert | 338/239 X |
| 2,981,821 | 4/1961 | Hayes | 219/437 X |
| 3,673,386 | 6/1972 | Drugmand et al. | 219/523 |
| 3,715,567 | 2/1973 | Mandziak | 219/437 |
| 3,732,398 | 5/1973 | Pease | 219/536 |
| 3,832,526 | 8/1974 | Clausse | 219/441 |
| 3,896,521 | 7/1975 | Parise | 15/321 |
| Re. 14,286 | 8/1917 | Mann | 219/508 |

*Primary Examiner*—Volodymyr Y. Mayewsky
*Attorney, Agent, or Firm*—Sughrue, Rothwell, Mion, Zinn and Macpeak

[57] ABSTRACT

Means for varying the heating rate of an immersion heater in a hot-water extraction unit comprising a solution tank in which an electrical immersion heater is mounted in order to decrease the warm-up time of the unit. In the preferred embodiment, the means comprise (a) a first heating element having a first watt rating; (b) a second heating element having a second watt rating, lower than the first watt rating; and (c) means for selectively actuating one or the other of the two heating elements.

2 Claims, 6 Drawing Figures

FIG. 2
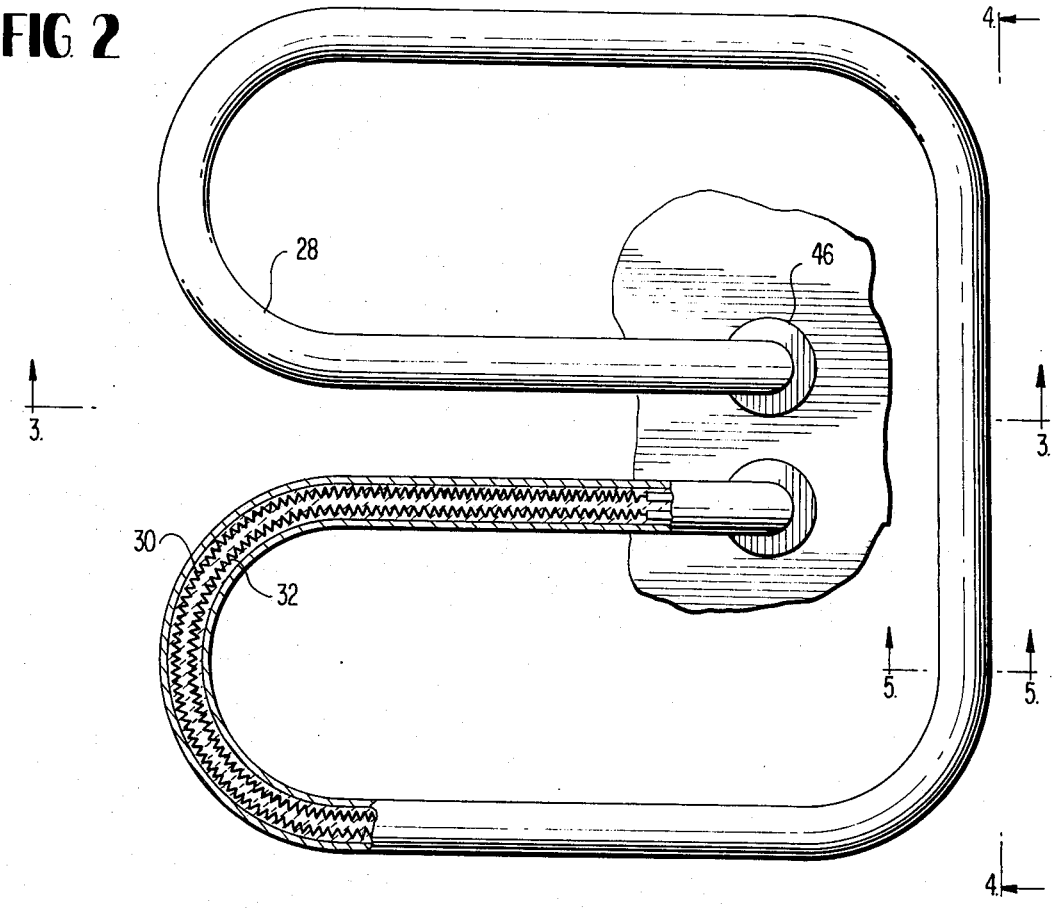
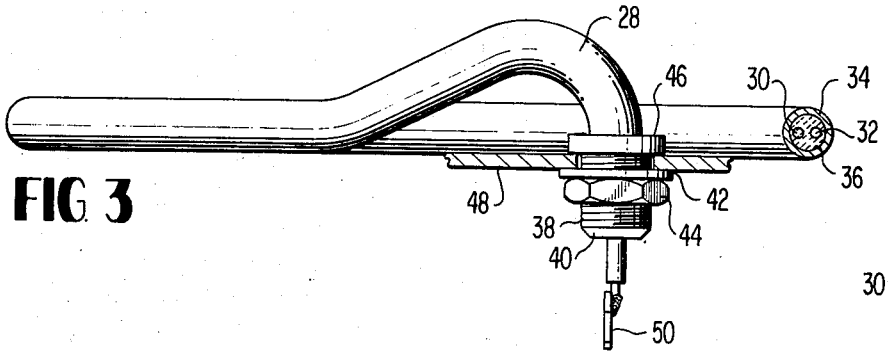
FIG. 3
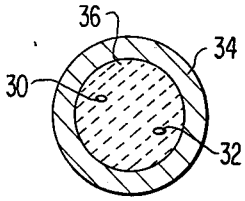
FIG. 5
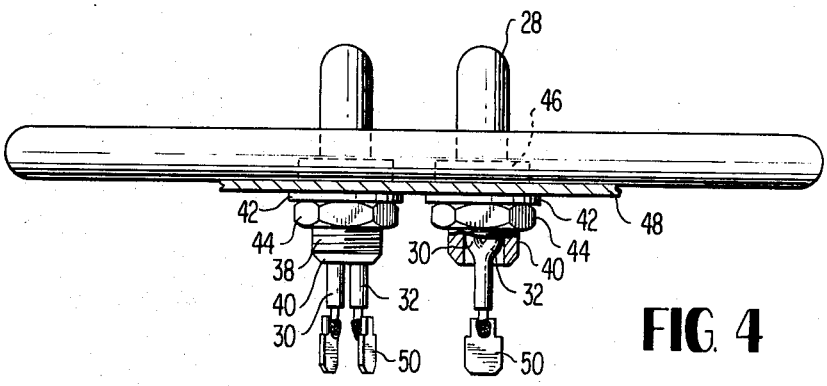
FIG. 4

HOT WATER EXTRACTION UNIT HAVING ELECTRICAL IMMERSION HEATER

FIELD OF THE INVENTION

This invention relates to hot water extraction units of the type in which either atomized, detergent-containing hot water or steam from a solution tank is sprayed on objects, such as rugs and other floor surfaces, to be cleaned, after which the hot water is re-collected into the unit by means of a vacuum wand. The present invention is of an improved immersion heater for the solution tanks of such units.

DESCRIPTION OF THE PRIOR ART

Hot-water extraction units having selectively actuable immersion heaters in their solution tanks are known and are shown, for example, in commonly assigned U.S. Pat. No. 3,896,521 issued July 29, 1975 to Carl Parise. In these units, however, the immersion heaters have a single heating rate - that is, they are either on or off and, when on, heat at a single watt rating. Since the units also comprise electrical vacuum motors and electrical pump motors which must be actuable while the immersion heater is on, the watt rating of the immersion heaters is necessarily limited to a value which, in combination with the watt rating of the vacuum motor and the pump motor and any other electrical components of the unit (such as warning lights) does not exceed the watt rating of the power supply, which is typically conventional house current. That is fine once the liquid supply in the solution tank has reached the desired operating temperature, but it creates a problem during initial heating of the liquid supply because an immersion heater subjected to the foregoing limitation is not large enough to heat the amount of liquid contained in a typical solution tank quickly.

OBJECT OF THE INVENTION

It is the object of this invention to provide means for decreasing the warm-up time of the liquid supply in the solution tank of hot water extraction units.

BRIEF DESCRIPTION OF THE DRAWINGS

FIG. 2 is a plan view, partially in section, of a portion of the preferred embodiment of the subject invention.

FIG. 3 is a view along the lines 3—3 in FIG. 2.

FIG. 4 is a view along the lines 4—4 in FIG. 2.

FIG. 5 is a view along the lines 5—5 in FIG. 2.

DETAILED DESCRIPTION OF THE PREFERRED EMBODIMENT

Figure 1:
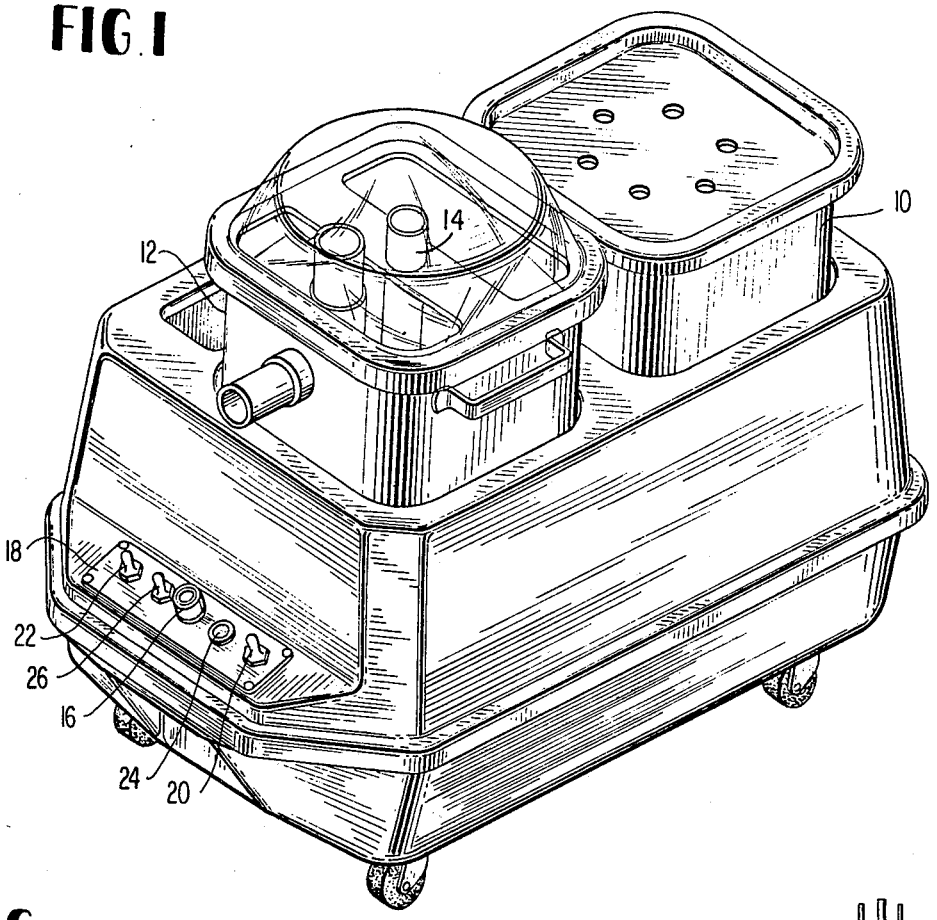
FIG. 1 is a perspective view of a hot-water extraction unit comprising the subject invention.

FIG. 1 shows a hot-water extraction unit manufactured by the assignee which employs the subject invention. It comprises a solution tank 10, a dump tank 12, an electrical vacuum motor 60 (not shown in FIG. 1) the vacuum pressure from which is communicated to the interior of the dump tank 12 by a riser pipe 14, and an electrical pump motor 56 (not shown in FIG. 1) which pumps liquid from the solution tank 10 out through a hot-water line (not shown) which may be connected to a quick disconnect 16 mounted on a control panel 18. Also mounted on the control panel 18 are a switch 20 for the vacuum motor, a three-way switch 22 which controls both a high-wattage pre-heater described hereinafter and the pump motor, an indicator light 24 which is on when the pre-heater is on and off when it is off, and a switch 26 which actuates a low-wattage running heater described hereinafter.

FIG. 2 is a plan view looking down into the solution tank 10 at the immersion heater 28 located in the bottom thereof. In the presently preferred embodiment, the immersion heater comprises a first heating element 30 having a first watt rating (1500 watts in the commercial embodiment) and a second heating element 32 having a second watt rating (300 watts in the commerical embodiment) lower than the first watt rating. The heating elements 30 and 32 are both mounted within a single metallic housing 34, within which they are embedded in a refractory material 36. Preferably the heating elements 30 and 32 comprise parallel helices, as shown in FIG. 2.

The mounting means for the immersion heater 28 are illustrated in FIGS. 3 and 4. As shown therein, they comprise external threads 38 on bulkhead fittings 40, copper-clad gaskets 42, and brass nuts 44, all of which co-operate with integral collars 46 to mount the immersion heater 28 on the bottom 48 of the solution tank 10. The height from the top of the immersion heater 28 to the bottom of the collar 46 is preferably a little bit less than the height from the top of the immersion heater 28 to the bottom of the immersion heater, providing a light spring pressure between the bottom of the immersion heater and the bottom 48 of the solution tank 10.

Projecting from the bottom of the bulkhead fittings 40 are the ends of the heating elements 30 and 32, to which are attached tabs 50. Thermal circuit breakers (not shown except in FIG. 6) are located beneath the bottom 48 of the solution tank 10 in close proximity to the immersion heater 28. The thermal circuit breakers are designed to interrupt the flow of current to the heating elements 30 and 32 when the temperature of the immersion heater 28 reaches a pre-selected temperature, for example, 175° F.

Figure 6:
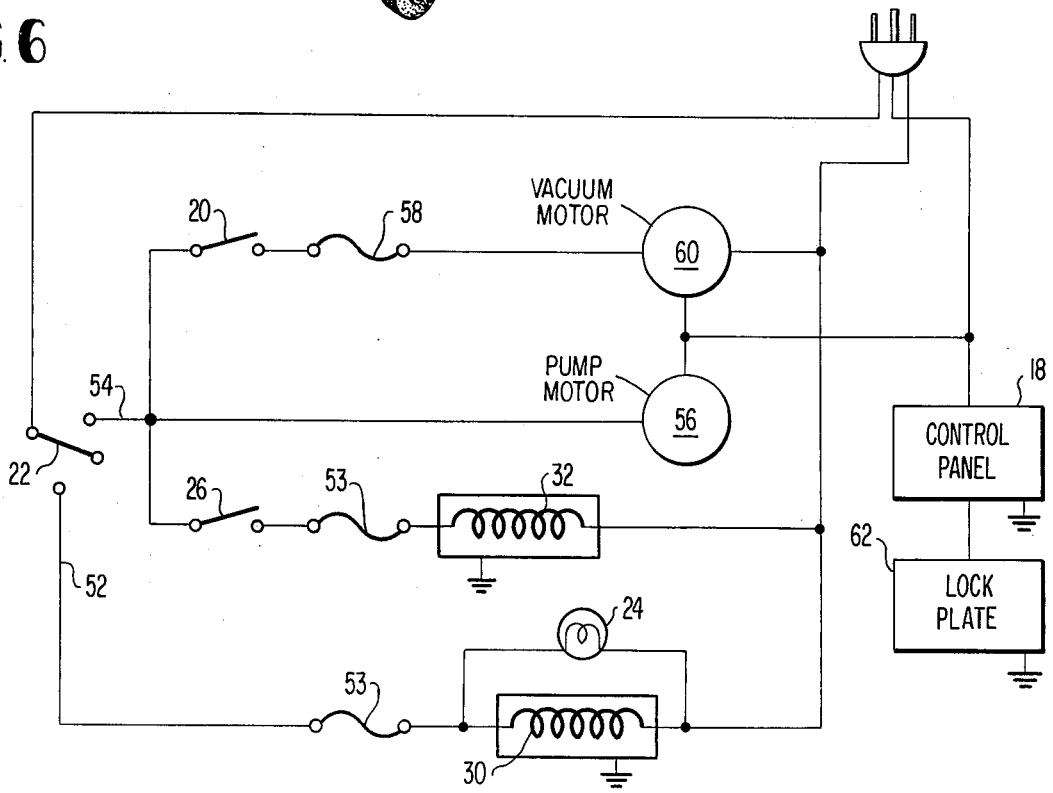
FIG. 6 is a wiring diagram for the subject invention.

The wiring diagram for the device shown in FIG. 1 is shown in FIG. 6. As shown therein, the circuitry comprises a pre-heating circuit 52 and a running circuit 54 which can be selectively actuated via the three-way switch 22. The pre-heating circuit 52 comprises a thermal circuit breaker 53, the heating element 30, and the indicator light 24 in parallel with the heating element 30. The running circuit 54 comprises three separate, parallel sub-circuits. The first sub-circuit comprises the pump motor 56, which goes on automatically when the three-way switch is turned to its upper position. The second sub-circuit comprises the switch 26, another thermal circuit breaker 53, and the low-wattage heater 32. The third sub-circuit comprises the switch 20, a circuit breaker 58, and the vacuum motor 60. The pump motor 56, the vacuum motor 60, the control panel 18, and a lock plate 62 are all wired to ground, and the heating elements 30, 32 and the indicator light are grounded by virtue of their direct electrical contact with other elements which are themselves grounded.

It will be appreciated that, while the presently preferred embodiment comprises two separate, selectively actuable heating elements, it would be perfectly possible to design an immersion heater having a single heating element with a continuously variable output, and accordingly the present invention may be described broadly as the provision in a solution tank for a hot-water extraction unit of an immersion heater comprising means for varying the heating rate of the immersion heater.

What is claimed is:

1. In a hot-water extraction unit comprising:

a solution tank, an electrical vacuum motor, an electrical pump motor, an electrical immersion heater, said heater being mounted within said tank, said immersion heater comprising a first high wattage heating element and a second low wattage heating element, circuit means for selectively connecting said heater elements and said motors across a source of electrical power, said circuit means comprising means defining a first circuit path for said first heater element and a second circuit path in parallel with said first path for said second heating element, switching means for alternately connecting said first and second current paths across said source, and means for connecting both electrical motors within said second circuit path;

whereby, said vacuum motor and said pump motor may be energized during energization of said second, low wattage heating element, but cannot be energized during energization of said first high wattage heating element.

2. The improvement recited in claim 1 wherein said first and second heating elements are both mounted within a single housing.

* * * * *